US011339736B2

(12) United States Patent
Kimura et al.

(10) Patent No.: US 11,339,736 B2
(45) Date of Patent: May 24, 2022

(54) CONTROL DEVICE

(71) Applicant: Hitachi Astemo, Ltd., Hitachinaka (JP)

(72) Inventors: Masaya Kimura, Hitachinaka (JP); Kyohei Matsumoto, Hitachinaka (JP); Ryo Sasaki, Hitachinaka (JP); Takuya Ikemoto, Hitachinaka (JP); Daichi Kawakami, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/386,212

(22) Filed: Jul. 27, 2021

(65) Prior Publication Data

US 2022/0034276 A1 Feb. 3, 2022

(30) Foreign Application Priority Data

Jul. 30, 2020 (JP) ..... JP2020-129450

(51) Int. Cl.
*F02D 41/20* (2006.01)

(52) U.S. Cl.
CPC ..... *F02D 41/20* (2013.01); *F02D 2041/2055* (2013.01)

(58) Field of Classification Search
CPC .. F02D 41/20; F02D 41/2441; F02D 41/2467; F02D 2041/2055; F02M 51/06; F02M 51/0682; F02M 61/04
See application file for complete search history.

(56) References Cited

U.S. PATENT DOCUMENTS

2016/0252037 A1* 9/2016 Katsurahara ..... F02D 41/2467 123/480
2016/0281629 A1* 9/2016 Moriya ..... F02D 41/2467
2019/0203687 A1* 7/2019 Yanoto ..... F02D 41/20
2019/0360424 A1* 11/2019 Parotto ..... F02D 41/20

FOREIGN PATENT DOCUMENTS

JP 2016180345 A 10/2016

* cited by examiner

*Primary Examiner* — John Kwon
*Assistant Examiner* — Johnny H Hoang
(74) *Attorney, Agent, or Firm* — Cantor Colburn LLP

(57) ABSTRACT

An electromagnetic valve driving device includes: a maximum detection unit configured to detect a maximum point when time-series data of a differential value of a counter electromotive voltage generated in a solenoid has changed from an increase to a decrease by retrospectively tracing the time-series data in an opposite direction of a time series; and a valve closing time detection unit configured to execute a determination process of retrospectively tracing the time-series data from the maximum point detected by the maximum detection unit in the opposite direction and scanning whether or not an amount of decrease in the differential value from the maximum point exceeds a predetermined threshold value and detect a maximum time, which is a time of the maximum point, as a valve closing time of a fuel injection valve when there is an event in which the amount of decrease exceeds the predetermined threshold value.

4 Claims, 6 Drawing Sheets

| TIME | DIFFERENTIAL VALUE d |
|---|---|
| t0 | d0 |
| t1 | d1 |
| t2 | d2 |
| t3 | d3 |
| t4 | d4 |
| t5 | d5 |
| t6 | d6 |
| ⋮ | ⋮ |
| t(n−1) | d(n−1) |
| tn | dn |

CONTROL DEVICE

CROSS REFERENCE TO RELATED APPLICATIONS

This present invention claims priority under 35 U.S.C. § 119 to Japanese Patent Application No. 2020-129450, filed Jul. 30, 2020, the entire content of which is incorporated herein by reference.

BACKGROUND OF THE INVENTION

Description of Related Art

An electromagnetic valve driving device that drives a fuel injection valve by controlling the energization of the fuel injection valve is known (see Japanese Unexamined Patent Application, First Publication No. 2016-180345).

The above electromagnetic valve driving device limits a change in an amount of injection of fuel to be injected from a fuel injection valve by controlling the energization of the fuel injection valve so that a period from closing to opening of the fuel injection valve becomes constant. Specifically, the electromagnetic valve driving device detects the closing of the fuel injection valve and controls the energization of the fuel injection valve so that a closing time (hereinafter referred to as a "valve closing time") becomes a target value.

SUMMARY OF THE INVENTION

The present inventors have found that the closing of a valve can be detected by detecting an inflection point (hereinafter referred to as a "valve closing inflection point") that initially appears in a time series in a differential waveform of a counter electromotive voltage generated in a fuel injection valve. Therefore, the present inventors have devised a method of scanning a differential value of a counter electromotive voltage in a time series and detecting a maximum value as a valve closing inflection point when an amount of decrease from the maximum value of the differential value exceeds a predetermined threshold value as a method of detecting the valve closing inflection point.

However, in the differential value in the time series, a second inflection point may appear without the amount of decrease from the valve closing inflection point exceeding a predetermined threshold value. Thus, in the above method, it may be difficult to detect the first inflection point, i.e., the valve closing inflection point.

The present invention has been made in view of such circumstances and an objective thereof is to provide a control device capable of reliably detecting a valve closing inflection point.

(1) According to an aspect of the present invention, there is provided a control device for controlling driving of a fuel injection valve having a solenoid coil, the control device including: a voltage detection unit configured to detect a counter electromotive voltage generated in the solenoid coil in time-series order; a differential calculation unit configured to obtain a differential value by differentiating the counter electromotive voltage detected by the voltage detection unit with respect to time; a storage unit configured to store time-series data of the differential value; a maximum detection unit configured to detect a maximum point when the differential value has changed from an increase to a decrease by retrospectively tracing the time-series data in an opposite direction of a time series; and a valve closing time detection unit configured to execute a determination process of retrospectively tracing the time-series data from the maximum point detected by the maximum detection unit in the opposite direction and scanning whether or not an amount of decrease in the differential value from the maximum point exceeds a predetermined threshold value and detect a maximum time, which is a time of the maximum point, as a valve closing time of the fuel injection valve when there is an event in which the amount of decrease exceeds the predetermined threshold value.

(2) In the control device according to the above-described (1), the valve closing time detection unit may execute the determination process for each maximum point when the maximum detection unit has detected a plurality of maximum points, and, if there are a plurality of valve closing candidate points that are the maximum points when it is determined that there is an event in which the amount of decrease exceeds the predetermined threshold value as a result of the determination process, the valve closing time detection unit may detect a shortest maximum time among maximum times of the valve closing candidate points as the valve closing time.

(3) In the control device according to the above-described (1), the valve closing time detection unit may execute the determination process for each maximum point when the maximum detection unit has detected a plurality of maximum points, and, if there are a plurality of valve closing candidate points that are the maximum points when it is determined that there is an event in which the amount of decrease exceeds the predetermined threshold value as a result of the determination process, the valve closing time detection unit may detect a maximum time of a valve closing candidate point at which the amount of decrease is largest among the valve closing candidate points as the valve closing time.

(4) In the control device according to any one of the above-described (1) to (3), the fuel injection valve may include a valve seat, a valve body configured to be separated from or in contact with the valve seat to open and close a fuel passage, a needle having a tip to which the valve body is fixed, and a movable core provided coaxially with the needle, and the valve body may be configured to be pulled up by a magnetic force generated by energizing the solenoid coil.

As described above, according to the control device of the above-described aspect, it is possible to detect a valve closing inflection point reliably.

DETAILED DESCRIPTION OF THE INVENTION

An electromagnetic valve driving device 1 according to the present embodiment is a driving device that drives a fuel injection valve L. Specifically, the electromagnetic valve driving device 1 according to the present embodiment is an electromagnetic valve driving device for driving the fuel injection valve L (an electromagnetic valve) that injects fuel into an internal combustion engine mounted in a vehicle.

The fuel injection valve L is an electromagnetic valve (a solenoid valve) that injects fuel into an internal combustion engine such as a gasoline engine or a diesel engine mounted in the vehicle. Hereinafter, a configuration example of the fuel injection valve L will be described with reference to FIG. 1.

Figure 1:
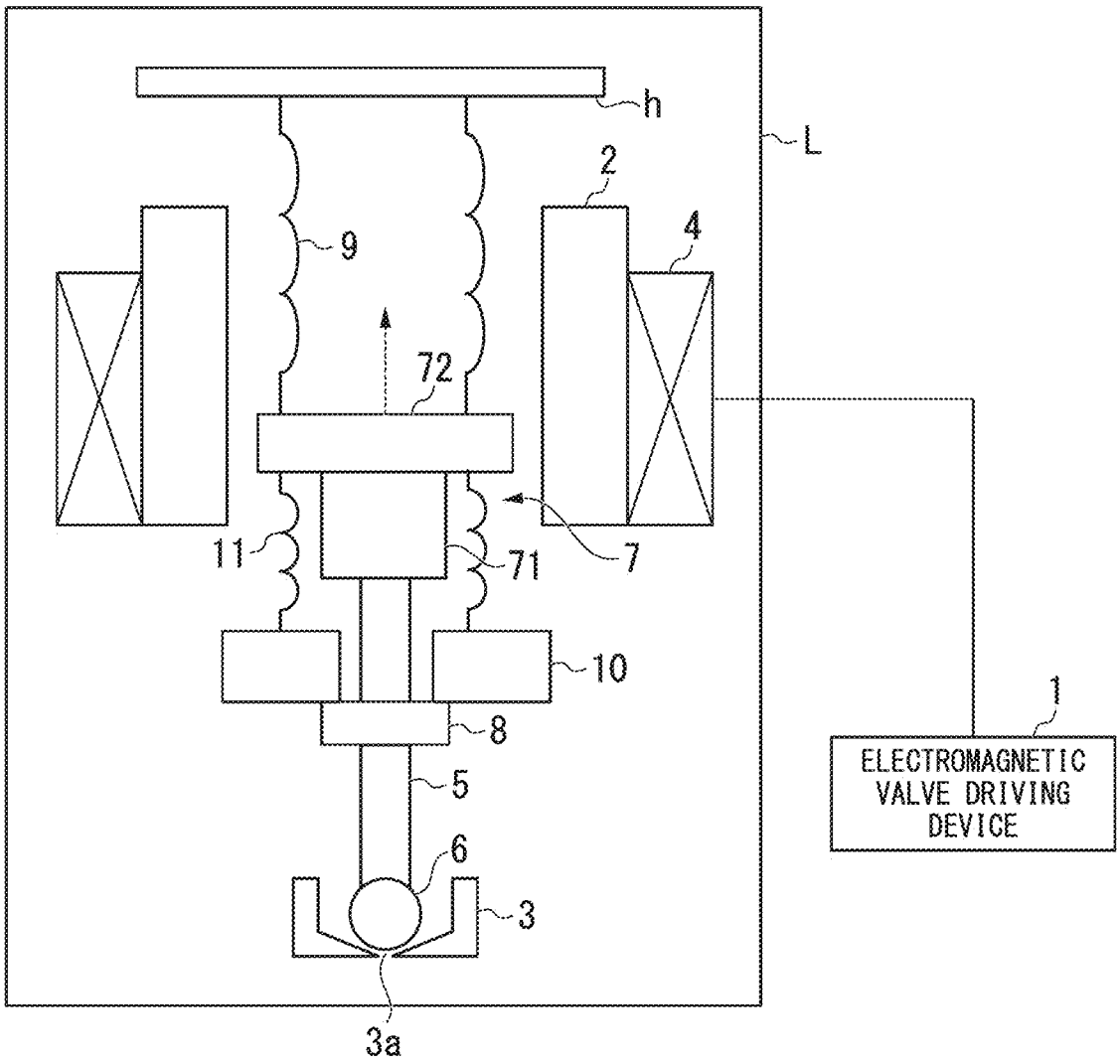
FIG. 1 is a schematic diagram showing a configuration example of a fuel injection valve L according to the present embodiment.

As shown in FIG. 1, the fuel injection valve L includes a fixed core 2, a valve seat 3, a solenoid coil 4, a needle 5, a valve body 6, a retainer 7, a lower stopper 8, a valve body biasing spring 9, a movable core 10, and a movable core biasing spring 11. In the present embodiment, the fixed core 2, the valve seat 3, and the solenoid coil 4 are fixed members and the needle 5, the valve body 6, the retainer 7, the lower stopper 8, the valve body biasing spring 9, the movable core 10, and the movable core biasing spring 11 are movable members.

The fixed core 2 is a cylindrical member and is fixed to a housing (not shown) of the fuel injection valve L. The fixed core 2 is formed of a magnetic material. The valve seat 3 is fixed to the housing of the fuel injection valve L. The valve seat 3 has an injection hole 3*a*. The injection hole 3*a* is a hole from which fuel is injected and is closed when the valve body 6 sits on the valve seat 3 and is opened when the valve body 6 is separated from the valve seat 3.

The solenoid coil 4 is formed by winding an electric wire in an annular shape. The solenoid coil 4 is disposed concentrically with the fixed core 2. The solenoid coil 4 is electrically connected to the electromagnetic valve driving device 1. The solenoid coil 4 is energized from the electromagnetic valve driving device 1 to form a magnetic path including the fixed core 2 and the movable core 10.

The needle 5 is a long rod member extending along a central axis of the fixed core 2. The valve body 6 is fixed to a tip of the needle 5. The needle 5 is moved in an axial direction (an extending direction of the needle 5) of the central axis of the fixed core 2 by an attractive force generated by a magnetic path including the fixed core 2 and the movable core 10. In the following description, in the axial direction of the central axis of the fixed core 2, the direction in which the movable core 10 moves due to the above-described attractive force is referred to as an upward direction and a direction opposite to a direction in which the movable core 10 moves due to the attractive force is referred to as a downward direction.

The valve body 6 is formed at a lower end of the needle 5. The valve body 6 closes the injection hole 3*a* by sitting on the valve seat 3 and opens the injection hole 3*a* by separating from the valve seat 3. That is, the valve body 6 opens and closes the fuel passage by separating from or abutting on the valve seat 3.

The retainer 7 includes a guide member 71 and a flange 72.

The guide member 71 is a cylindrical member fixed to an upper end of the needle 5.

The flange 72 is provided on an upper end portion of the guide member 71. The flange 72 is formed to project in a radial direction of the needle 5. That is, the flange 72 has a larger outer diameter dimension than the guide member 71.

A lower end surface of the flange 72 is a surface abutting on the movable core biasing spring 11. An upper end surface of the flange 72 is a surface abutting on the valve body biasing spring 9.

For example, the valve body 6 is a needle valve that is separate from the movable core 10 and is pulled up by a magnetic force generated by energizing the solenoid coil.

The lower stopper 8 is a cylindrical member fixed to the needle 5 at a position between the valve seat 3 and the guide member 71. An upper end surface of the lower stopper 8 is a surface abutting on the movable core 10.

The valve body biasing spring 9 is a compression coil spring stored inside the fixed core 2 and is inserted between an inner wall surface h of the housing and the flange 72. The valve body biasing spring 9 biases the valve body 6 downward. That is, when the coil 14 is not energized, the valve body 6 abuts on the valve seat 3 due to a biasing force of the valve body biasing spring 9.

The movable core 10 is disposed between the guide member 71 and the lower stopper 8. The movable core 10 is a cylindrical member and is provided coaxially with the needle 5. The movable core 10 includes a through-hole formed at the center thereof such that the needle 5 is inserted, and can move along the extending direction of the needle 5.

An upper end surface of the movable core 10 is a surface abutting on the retainer 7, the fixed core 2, and the movable core biasing spring 11. On the other hand, the lower end surface of the movable core 10 is a surface abutting on the lower stopper 8. The movable core 10 is formed of a magnetic material.

The movable core biasing spring 11 is a compression coil spring inserted between the flange 72 and the movable core 10. The movable core biasing spring 11 biases the movable core 10 downward. That is, when the solenoid coil 4 is not supplied with electric power, the movable core 10 abuts on the lower stopper 8 by the biasing force of the movable core biasing spring 11.

Next, the electromagnetic valve driving device 1 according to the present embodiment will be described.

Figure 2:
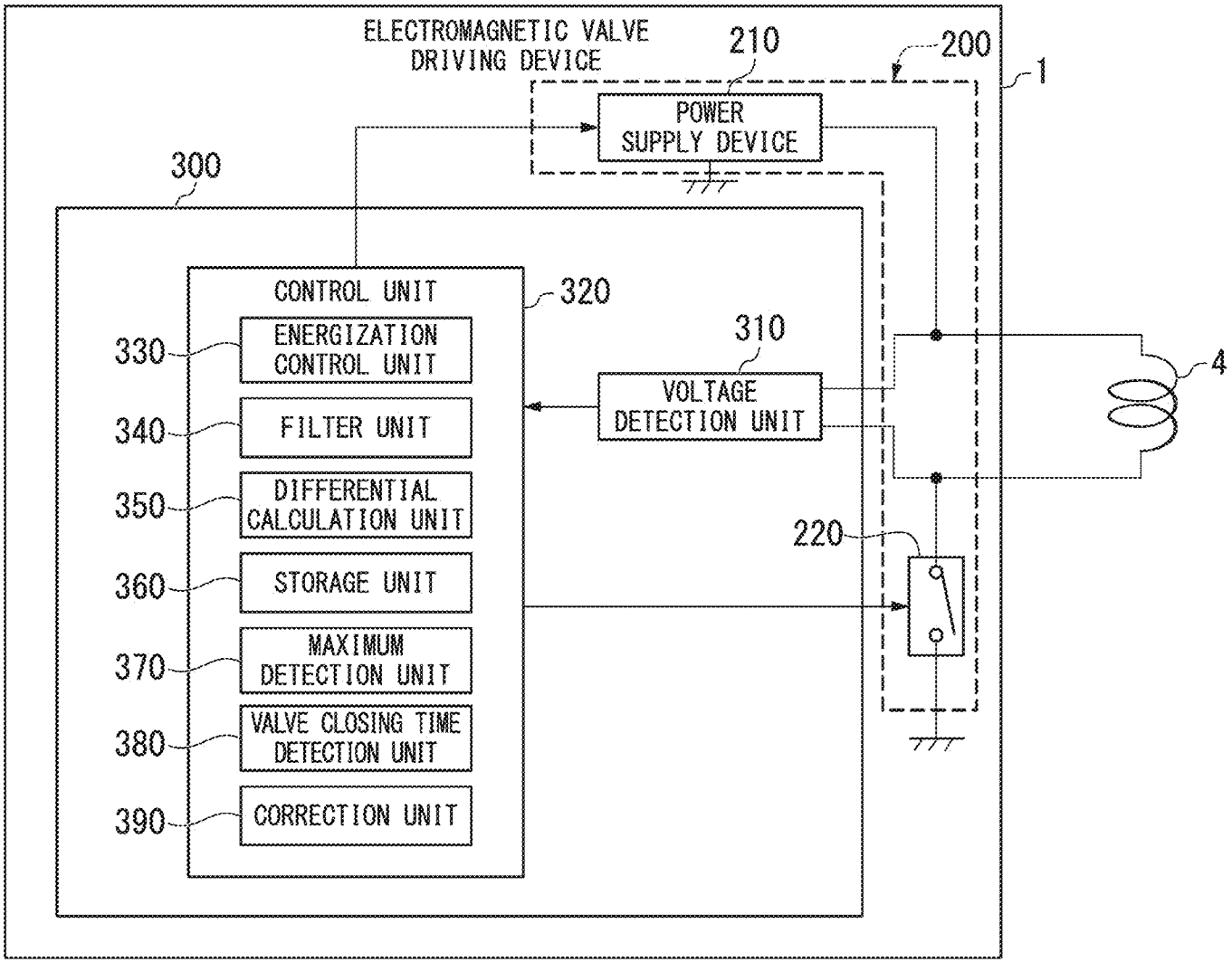
FIG. 2 is a circuit diagram showing a configuration example of an electromagnetic valve driving device 1 according to the present embodiment.

As shown in FIG. 2, the electromagnetic valve driving device 1 includes a driving device 200 and a control device 300.

The driving device 200 includes a power supply device 210 and a switch 220.

The power supply device 210 includes at least one of a battery and a booster circuit. The battery is mounted in the vehicle. The booster circuit boosts a battery voltage Vb, which is an output voltage of the battery, and outputs a boosted voltage Vs, which is a voltage that has been boosted.

The power supply device 210 energizes the solenoid coil 4 by outputting the boosted voltage Vs to the solenoid coil 4. The power supply device 210 may energize the solenoid coil 4 by outputting the battery voltage Vb to the solenoid coil 4. The voltage output from the power supply device 210 to the solenoid coil 4 is controlled by the control device 300. Also, the energization of the solenoid coil 4 is controlled by the control device 300.

The switch 220 is controlled so that it is in an ON state or an OFF state by the control device 300. When the switch 220 is controlled so as to be in the ON state, the voltage output from the power supply device 210 is supplied to the solenoid coil 4. Thereby, energization of the solenoid coil 4 is started. When the switch 220 is controlled so as to be in the OFF state, the supply of a voltage from the power supply device 210 to the solenoid coil 4 is stopped.

The control device 300 includes a voltage detection unit 310 and a control unit 320.

The voltage detection unit 310 detects a voltage value Vc generated in the solenoid coil 4 in time-series order. For example, the voltage value Vc indicates a voltage across the solenoid coil 4. The voltage detection unit 310 outputs the detected voltage value Vc to the control unit 320. The voltage detection unit 310 detects a counter electromotive voltage generated in the solenoid coil 4 in time-series order. Here, the counter electromotive voltage is the voltage value Vc after the energization of the solenoid coil 4 is stopped.

The control unit 320 controls an amount of injection of fuel to be injected from the fuel injection valve L (hereinafter referred to as an "amount of fuel injection") such that it is constant by controlling the energization time of the solenoid coil 4. The control unit 320 detects the closing of the valve by detecting an inflection point (hereinafter referred to as a "valve closing inflection point") that initially appears in a differential waveform of the counter electromotive voltage of the solenoid coil 4 detected by the voltage detection unit 310. For example, the control unit 320 detects a time when the valve closing inflection point appears as a valve closing time. The control unit 320 controls the amount of fuel injection such that it is constant all the time by correcting the energization time of the solenoid coil 4 so that the valve closing time becomes a target value. The valve closing time is a time period from the start of energization of the solenoid coil 4 to the closing of the fuel injection valve L as an example, but is not limited thereto. The valve closing time may be a time period from the stopping of the energization of the solenoid coil 4 to the closing of the fuel injection valve L.

The functional unit of the control unit 320 will be described below. The control unit 320 includes an energization control unit 330, a filter unit 340, a differential calculation unit 350, a storage unit 360, a maximum detection unit 370, a valve closing time detection unit 380, and a correction unit 390.

The energization control unit 330 controls the power supply device 210. The energization control unit 330 controls the switch 220 so that it is in the ON state or the OFF state. The energization control unit 330 causes the voltage to be supplied from the power supply device 210 to the solenoid coil 4 by controlling the switch 220 so that it is in the ON state. The energization control unit 330 causes the supply of a voltage from the power supply device 210 to the solenoid coil 4 to be stopped by controlling the switch 220 so that it transitions from the ON state to the OFF state. The energization control unit 330 controls an amount of injection of fuel injected from the fuel injection valve L (hereinafter referred to as an "amount of fuel injection") such that it is constant by controlling an energization time period Ti (=T2−T1) which is a time period from the start of energization of the solenoid coil 4 at the preset energization start time T1 to the time (energization stop time) T2 at which the energization is stopped.

Here, when the supply of a voltage to the solenoid coil 4 is stopped, a counter electromotive voltage is generated in the solenoid coil 4 and a counter electromotive voltage is generated at both ends of the solenoid coil 4. The above counter electromotive voltage decreases with time and disappears after the elapse of a predetermined time period. Until the above voltage difference disappears, the valve body 6 of the fuel injection valve L that has been opened collides with the valve seat 3 and is closed and a decreasing gradient of the voltage difference changes when the valve body 6 collides with the valve seat 3. The control unit 320 of the present embodiment detects the closing of the fuel injection valve L by detecting the change in the decreasing gradient.

The filter unit 340 performs a filtering process on the voltage value Vc output from the voltage detection unit 310. The above voltage value Vc is a voltage value Vc after the switch 220 is controlled so that it transitions from the ON state to the OFF state, and is a so-called counter electromotive voltage. The filtering process is a process of removing a noise component included in a voltage waveform having the voltage value Vc using a low-pass filter. That is, the filter unit 340 executes a filtering process of removing components having a predetermined frequency or higher by applying the low-pass filter to the voltage value Vc. For example, the low-pass filter is a digital low-pass filter. The filter unit 340 outputs the voltage value Vc after the filtering process to the differential calculation unit 350.

The differential calculation unit 350 generates time-series data of the differential value d by time-differentiating the voltage value Vc filtered by the filter unit 340. The differential calculation unit 350 stores the generated time-series data of the differential value d in the storage unit 360. The differential value d of the present embodiment is a value of a first-order differential of the voltage value Vc (the counter electromotive voltage), but is not limited thereto. The differential value d of the present embodiment may be a value of a higher-order differential which is higher than or equal to a second-order differential.

Here, the differential calculation unit 350 generates differential values d of voltage values Vc from a first time to a second time when a predetermined time period ΔT has elapsed and stores the generated differential values d in time-series order in the storage unit 360. For example, the first time is the energization start time T1 or the energization stop time T2. The predetermined time period ΔT is a time period that is sufficiently longer than a time period from the first time to the time at which the fuel injection valve L is closed, and is preset. A time period (for example, the number of digits) from the first time to the closing of the fuel injection valve L is known in advance by experiments and the like. Therefore, the predetermined time period ΔT is set to a time period sufficiently longer than the valve closing time.

Figure 3:
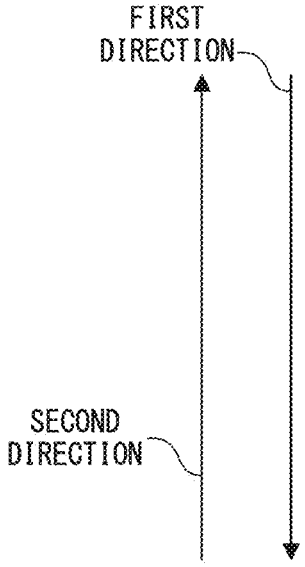
FIG. 3 is a diagram for describing an example of time-series data according to the present embodiment.

The storage unit 360 stores the time-series data of the differential values d generated by the differential calculation unit 350. That is, the storage unit 360 stores the differential values d generated by the differential calculation unit 350 in time-series order. The time-series data stored in the storage unit 360 is data of differential values d in the time-series order from the first time to the second time. As an example, FIG. 3 shows time-series data stored in the storage unit 360. As shown in FIG. 3, the time-series data is data of differential values d1 to dn for time periods from t0, which is the first time, to times t1, t2, t3, t4, t5, t6, . . . , t(n−1) in time-series order, i.e., in the order in which time elapses. Here, tn is the second time. Δt=(tn−t0).

The maximum detection unit 370 retrospectively reads the time-series data stored in the storage unit 360 in an opposite direction of a time series (a second direction), and detects a maximum time, which is a point in time when the differential value d changes from an increase to a decrease, and a differential value d (hereinafter referred to as a "maximum value") at the maximum time. That is, the maximum detection unit 370 retrospectively reads the time-series data stored in the storage unit 360 in an opposite direction of a time series and detects a maximum point (a maximum time and a maximum value) when the differential value d changes from an increase to a decrease.

Here, retrospectively tracing the time-series data in an opposite direction of time series order is retrospectively tracing the time-series data from the second time to the first time. The time series is a direction in which time elapses and is a first direction from the first time to the second time. The opposite direction of the time series is a direction opposite to the direction in which time elapses and is a second direction from the second time to the first time. For example, in the example of the time-series data shown in FIG. 3, the maximum detection unit 370 reads differential values d from tn, which is the second time, in the order of t(n−1), t6, t5, t4, t3, t2, t1, and t0. That is, the maximum detection unit 370 reads the differential values d in the order of dn, d(n−1), . . . , d6, d5, d4, d3, d2, d1, and d0. The maximum detection unit 370 detects the maximum point which is an inflection point when the differential value d read from the second time changes from an increase to a decrease.

When the maximum point has been detected by the maximum detection unit 370, the valve closing time detection unit 380 performs a threshold value determination process of retrospectively tracing the differential value d in the second direction from the maximum point (the maximum time) and scanning whether or not an amount of decrease Δd of the differential value d from the maximum value exceeds a predetermined threshold value Δdth. When the amount of decrease Δd that has been obtained exceeds the predetermined threshold value Δdth, the valve closing time detection unit 380 obtains the valve closing time of the fuel injection valve using the maximum time of the maximum point at that time. For example, the valve closing time detection unit 380 performs a scan process in the second direction from the maximum point and obtains the maximum time of the maximum point as the closing time of the fuel injection valve L when there is an event in which the amount of decrease Δd exceeds the predetermined threshold value Δdth.

When a plurality of maximum points have been detected by the maximum detection unit 370, the valve closing time detection unit 380 performs a threshold value determination process for each maximum point. When there are a plurality of maximum points (hereinafter referred to as "valve closing candidate points") at which the amount of decrease Δd exceeds the predetermined threshold value Δdth as a result of performing the threshold value determination process for each maximum point, the valve closing time detection unit 380 may detect the maximum time of the valve closing candidate point having the shortest time from the first time among the plurality of valve closing candidate points as the valve closing time.

Also, when there are a plurality of valve closing candidate points, the valve closing time detection unit 380 may detect the maximum time of the valve closing candidate point having the largest amount of decrease among the plurality of valve closing candidate points as the valve closing time.

Figure 4:
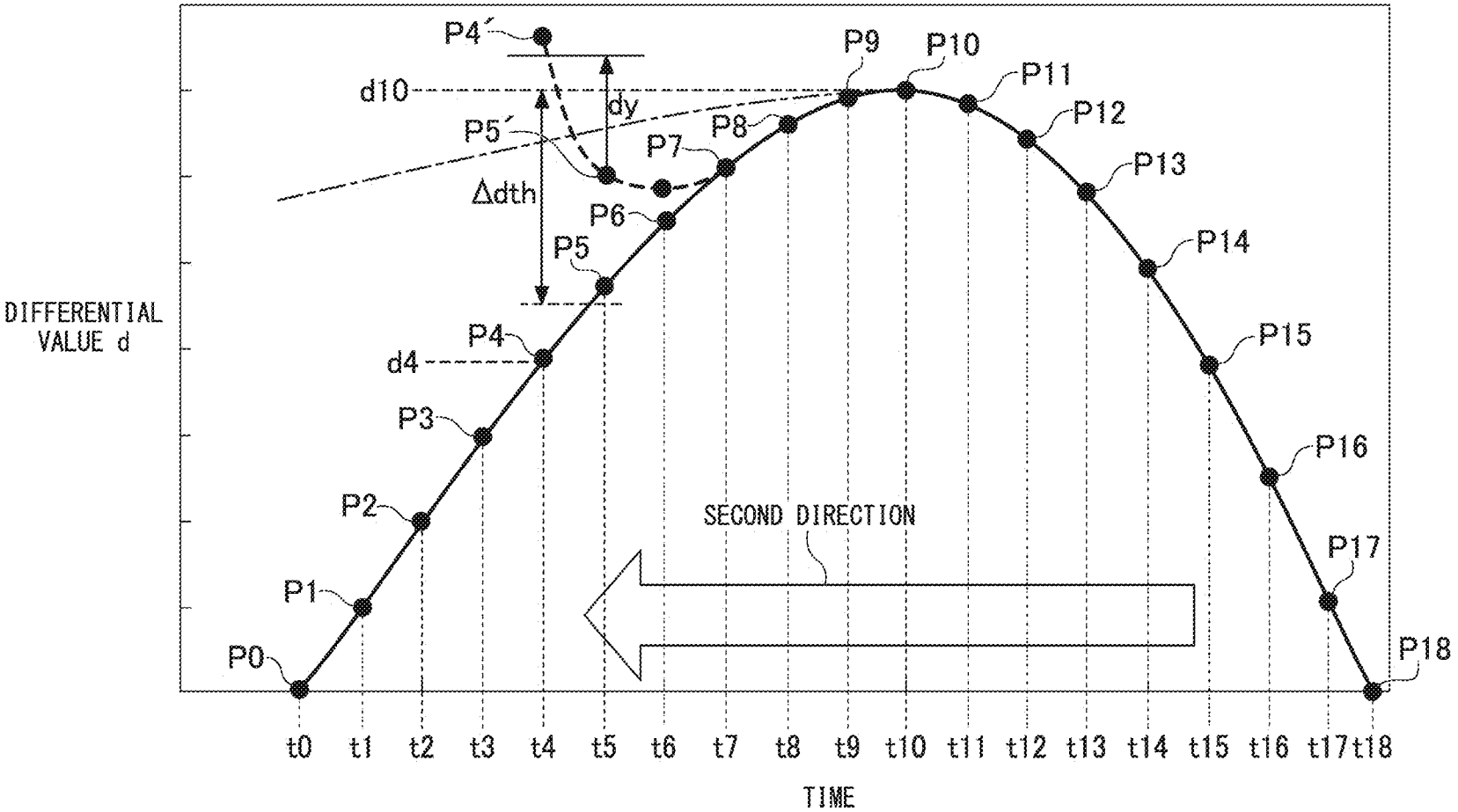
FIG. 4 is a graph for describing an example of a valve closing time detection method according to the present embodiment.

An example of a valve closing time detection method of the present embodiment will be described with reference to FIG. 4. For example, the storage unit 360 stores time-series data from t0, which is the first time, to t18, which is the second time. The maximum detection unit 370 retrospectively reads the time-series data stored in the storage unit 360 from t18, which is the second time, and scans whether or not there is a maximum point at which the differential value d changes from an increase to a decrease in order. When the maximum point has been detected, the maximum detection unit 370 outputs the maximum point to the valve closing time detection unit 380. In the example of FIG. 4, the maximum detection unit 370 detects a point P10 indicated by a differential value d10 at the time t10 as the maximum point.

The valve closing time detection unit 380 retrospectively traces the time-series data in the second direction from time t10 at the point P10, which is the maximum point and scans whether or not there is a differential value d in which the amount of decrease Δd from the differential value d10 (the maximum value) exceeds the predetermined threshold value Δdth. In the example shown in FIG. 4, when the time-series data is retrospectively traced in the second direction from the time t10 of the point P10 which is the maximum point, the amount of decrease Δd (=d10−d4) from the differential value d10 (the maximum value) at the point P4 exceeds the predetermined threshold value Δdth, so that the valve closing time detection unit 380 detects t10, which is the maximum time, as the valve closing time using the point P10, which is the maximum point, as the valve closing inflection point.

When the maximum point has been detected by the maximum detection unit 370, the valve closing time detection unit 380 may execute a condition determination process of determining whether or not at least one of the following first to third conditions is satisfied at the maximum point. When at least one of the following first to third conditions is satisfied in the condition determination process, the valve closing time detection unit 380 performs the condition determination process with respect to the next maximum point in a state in which it is assumed that the maximum time of the maximum point is not the valve closing time. The valve closing time detection unit 380 obtains the maximum time of the maximum point as the valve closing time of the fuel injection valve if the amount of decrease Δd exceeds the predetermined threshold value Δdth according to the threshold value determination process when none of the following first to third conditions is satisfied in the condition determination process.

(a) First condition: This is a condition in which, when the differential value d is retrospectively traced from the maximum point (the maximum time) to the first time, the differential value d is increased by a predetermined value dy or more.

(b) Second condition: This is a condition in which, when the differential value d is retrospectively traced from the maximum point (the maximum time) to the first time, the differential value d becomes greater than or equal to the maximum value of the maximum point.

(c) Third condition: This is a condition in which, when the differential value d is retrospectively traced from the maximum point (the maximum time) to the first time, there is no amount of decrease Δd that exceeds the predetermined threshold value Δdth until a predetermined time period elapses.

As an example of the first condition, when the time-series data has been retrospectively traced from the maximum point P10, which is the maximum point, to the first time, the differential value d increases and an amount of change from the differential value d5 of the point P5 (a point P5' shown in FIG. 4) to the differential value d4 of the point P4 (a point P4' shown in FIG. 4) becomes greater than or equal to a predetermined value dy, the valve closing time detection unit 380 excludes the point P10, which is the maximum point, from the valve closing inflection point.

As an example of the second condition, the differential value d increases when the time-series data has been retrospectively traced from the point P10, which is the maximum point, to the first time and the valve closing time detection unit 380 excludes the point P10, which is the maximum point, from the valve closing inflection point when the differential value d4 of the point P4 (the point P4' shown in FIG. 4) is greater than or equal to d10 which is a maximum value.

As an example of the third condition, when the time-series data has been retrospectively traced from the point P10, which is the maximum point, to the first time, the valve closing time detection unit 380 excludes the point P10, which is the maximum point, from the valve closing inflection point if there is no amount of decrease Δd exceeding the predetermined threshold value Δdth (as indicated by the alternate long and short dash line shown in FIG. 4) until a predetermined time period (for example, from t10 to t0) elapses.

The correction unit 390 corrects the energization time period Ti in accordance with the valve closing time obtained by the valve closing time detection unit 380. For example, the correction unit 390 corrects the energization time period Ti so that the valve closing time becomes a target value. As an example, the correction unit 390 corrects the energization time period Ti by adjusting an energization stop time so that there is no difference between the valve closing time and the target value.

Figure 5:
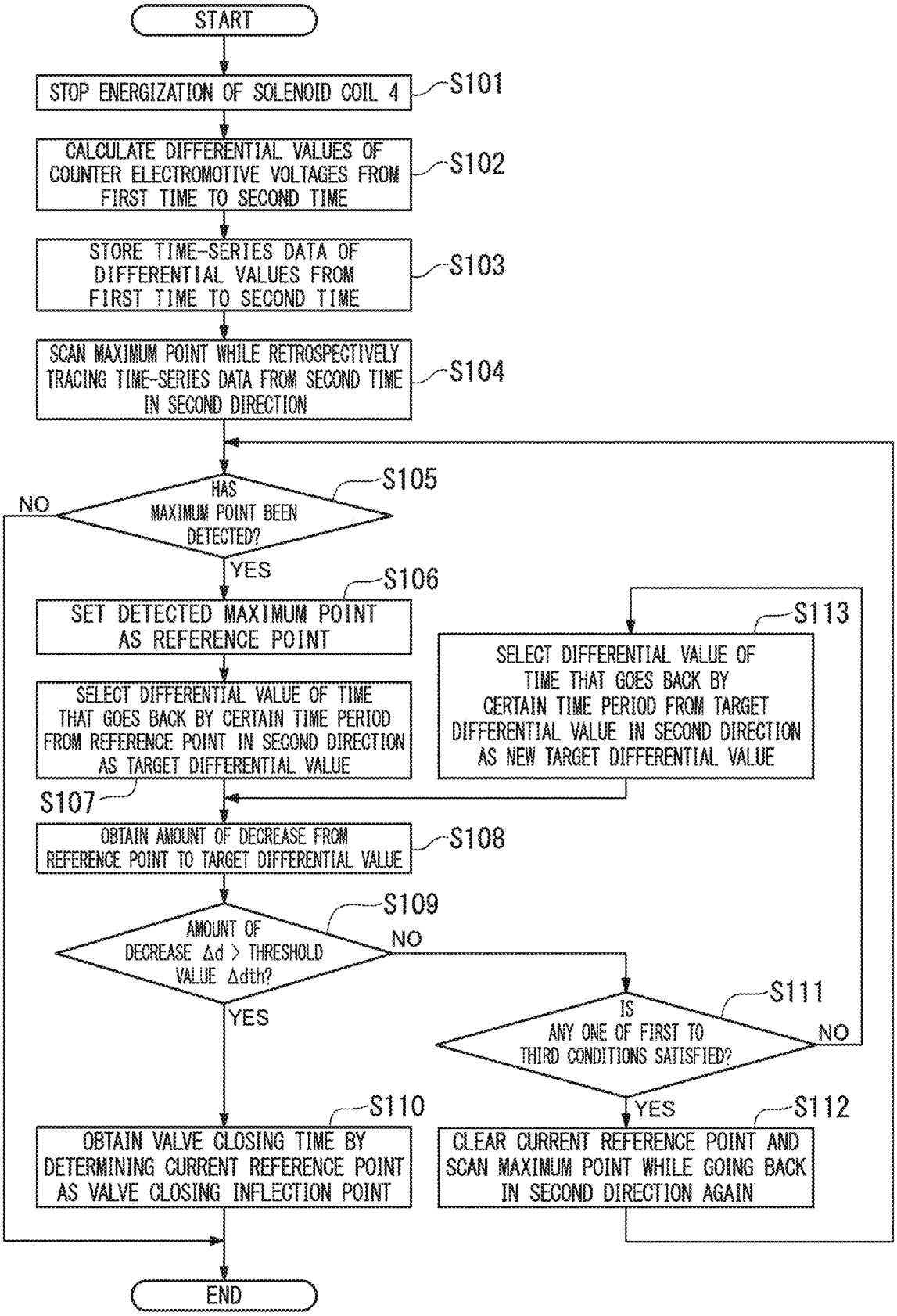
FIG. 5 is a flowchart for describing an example of a flow of an operation of a control device 300 according to the present embodiment.

Hereinafter, an example of a flow of the operation of the control device 300 will be described with reference to FIG. 5.

When the fuel injection valve L is opened, the control device 30 starts the energization of the solenoid coil 4 at a preset energization start time T1 and then stops the energization of the solenoid coil 4 at an energization stop time T2 when the energization time period Ti has elapsed (step S101).

The control unit 320 time-differentiates the voltage value Vc from the first time after the energization of the solenoid coil 4 is stopped in the first direction and generates the differential value d of the voltage value Vc (step S102). The control unit 320 stores the time-series data of the differential value d from the first time to the second time by storing the differential value d of the generated voltage value Vc in the storage unit 360 (step S103).

The control unit 320 reads the time-series data stored in the storage unit 360 retrospectively from the second time in the second direction and scans the maximum point at which the differential value d changes from an increase to a decrease (step S104). The control unit 320 determines whether or not the maximum point has been detected (step S105). When it is determined that the maximum point has been detected, the control unit 320 sets the maximum point as a reference point (step S106). The control unit 320 selects a differential value of time of time-series data retrospectively traced in the second direction by a certain time period (for example, a sampling time period of the differential value d) from the reference point as a target differential value (step S107). For example, when a point Pn has been used as the reference point, the control unit 320 selects a differential value of time of a point Pn−1 of time-series data retrospectively traced in the second direction by a certain time period from the reference point as the target differential value.

The control unit 320 obtains the amount of decrease Δd from the differential value d of the reference point to the target differential value (step S108) and performs a threshold value determination process of determining whether or not the obtained amount of decrease Δd exceeds the predetermined threshold value Δdth (step S109). When the amount of decrease Δd exceeds the predetermined threshold value Δdth, the control unit 320 determines a current reference point as the valve closing inflection point (step S110). That is, when the amount of decrease Δd exceeds the predetermined threshold value Δdth, the control unit 320 determines a time (a maximum time) of the current reference point as the valve closing time.

When the amount of decrease Δd does not exceed the predetermined threshold value Δdth in step S109, the control unit 320 determines whether or not any one of the first to third conditions is satisfied (step S111). When any one of the first to third conditions is satisfied, the control unit 320 reads back from the current reference point in the second direction again and scans the maximum point at which the differential value d changes from the increase to the decrease (step S112). The control unit 320 returns to step S105 and determines whether or not the maximum point has been detected. Also, when it is determined that the maximum point has been detected, the control unit 320 clears the current reference point and sets the newly detected maximum point as the reference point. The control unit 320 moves to step S107.

When none of the first to third conditions is satisfied in step S111, the control unit 320 selects a differential value of time that goes back in the second direction by a certain time period from the target differential value as a new target differential value (step S113). The control unit 320 moves to step S108.

Figure 6:
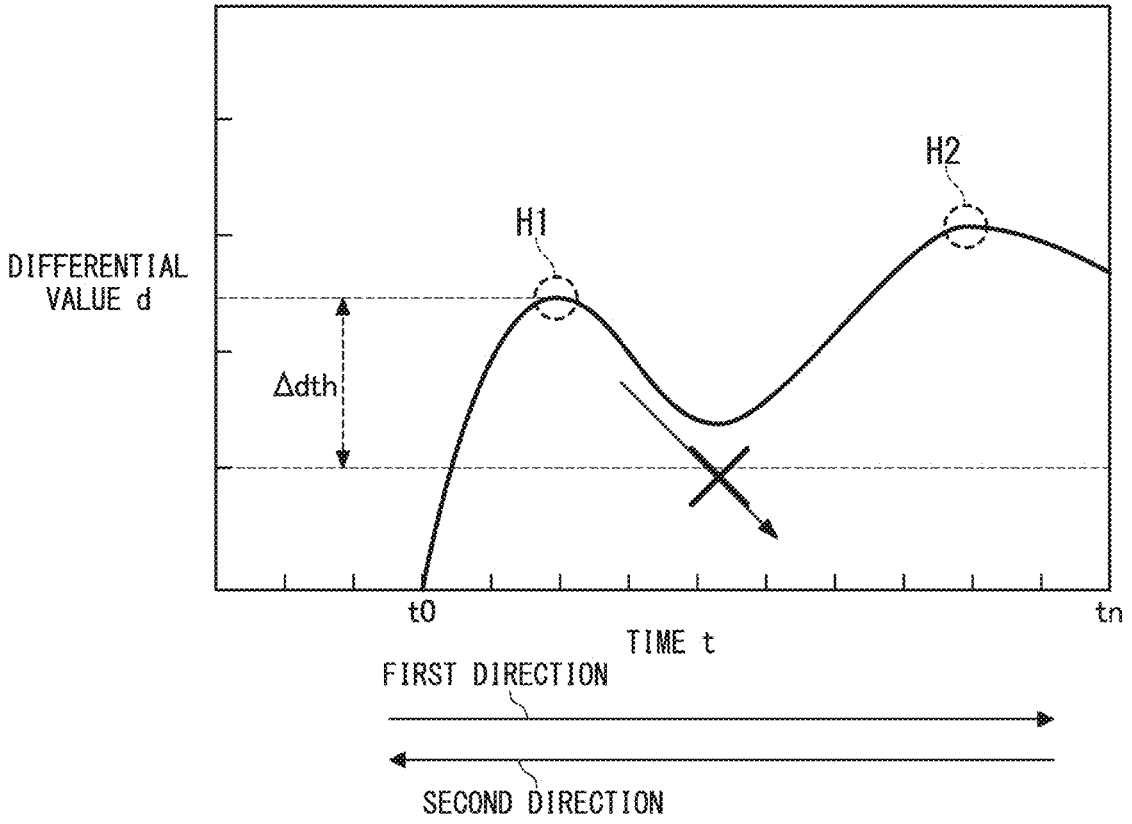
FIG. 6 is a graph for describing the operations and advantageous effects of the present embodiment.

Hereinafter, the operations and advantageous effects of the present embodiment will be described with reference to FIG. 6. When the valve is closed, the movable core 10 is lowered downward and the valve body 6 collides with the valve seat 3 and the movable core 10 is separated from the retainer at a timing when the fuel injection valve L is closed. Thereby, the acceleration of the movable core 10 changes, so that a magnetic flux within the magnetic path changes and the counter electromotive voltage changes. As a result, a first inflection point H1 is formed in the differential value d of the counter electromotive voltage. The above first inflection point H1 becomes the valve closing inflection point. However, after the valve is closed, a descent speed of the movable core 10 is decelerated due to the occurrence of the reverberation of the fuel pressure and the bounce of the valve body 6 and the like, so that the counter electromotive voltage changes and a second inflection point H2 is formed after the first inflection point H1 at the differential value d. The second inflection point H2 is not the first inflection point H1 due to the closing of the valve. Thus, the valve closing time detection unit 380 detects the closing of the fuel injection valve L by detecting the first inflection point H1 instead of the second inflection point H2.

As an example, there is a method of scanning time-series data of the differential values d for a maximum value in the first direction and detecting the maximum value as a valve closing inflection point when the amount of decrease Δd from the maximum value exceeds the predetermined threshold value Δdth. In the above method, as shown in FIG. 6, the amount of decrease Δd from an initially detected maximum value may not exceed the predetermined threshold value Δdth. As a result, the first inflection point H1 may not be detected. On the other hand, the control device 300 of the present embodiment scans the time-series data of the differential values d in the second direction instead of the first direction and detects the maximum value as a valve closing inflection point when the amount of decrease Δd from the maximum value exceeds the predetermined threshold value Δdth. Here, at the first inflection point H1, a case in which the amount of decrease Δd does not exceed the predetermined threshold value Δdth may occur in the first direction, but a case in which the amount of decrease Δd does not exceed the predetermined threshold value Δdth does not occur in the second direction. This is because, in the second direction, the maximum value does not occur after the first inflection point H1 and the differential value d after the first inflection point H1 converges to zero. Thereby, the control device 300 of the present embodiment can reliably detect the valve closing inflection point.

Although embodiments of the present invention have been described above with reference to the drawings, specific configurations are not limited to the embodiments and other designs and the like may also be included without departing from the scope of the present invention.

The control device 300 of the above-described embodiment performs a determination process of retrospectively tracing the time-series data from the maximum point in the second direction and scanning whether or not the amount of decrease Δd of the differential value d from the maximum point exceeds the predetermined threshold value Δdth and detects the maximum time, which is the time of the maximum point, as the valve closing time of the fuel injection valve L when there is an event in which the amount of decrease Δd exceeds the predetermined threshold value Δdth. Thereby, the valve closing inflection point can be reliably detected.

The control device 300 may retrospectively trace the time-series data from the second time to the first time, detect the maximum point using the maximum detection unit 370, perform a determination process for each maximum point when the maximum detection unit 370 detects a plurality of maximum points, and detect a shortest maximum time among maximum times of the valve closing candidate points as the valve closing time if there are a plurality of valve closing candidate points that are the maximum points when it is determined that there is an event in which the amount of decrease Δd exceeds the predetermined threshold value Δdth as a result of the determination process. Thereby, it is possible to limit erroneous detection of the valve closing inflection point.

The control device 300 may retrospectively trace the time-series data from the second time to the first time, detect the maximum point using the maximum detection unit 370, perform a determination process for each maximum point when the maximum detection unit 370 detects a plurality of maximum points, and detect a maximum time of a valve closing candidate point at which the amount of decrease Δd is largest among valve closing candidate points as the valve closing time if there are a plurality of valve closing candidate points that are the maximum points when it is determined that there is an event in which the amount of decrease Δd exceeds the predetermined threshold value Δdth as a result of the determination process. Thereby, it is possible to limit erroneous detection of the valve closing inflection point.

According to the control device of the present invention, it is possible to detect a valve closing inflection point reliably. Consequently, the industrial applicability is significant.

EXPLANATION OF REFERENCES

L Fuel injection valve
1 Electromagnetic valve driving device
300 Control device
310 Voltage detection unit
320 Control unit
350 Differential calculation unit
360 Storage unit
370 Maximum detection unit
380 Valve closing time detection unit

What is claimed is:

1. A control device for controlling driving of a fuel injection valve having a solenoid coil, the control device comprising:

a voltage detection unit configured to detect a counter electromotive voltage generated in the solenoid coil in time-series order;

a differential calculation unit configured to obtain a differential value by differentiating the counter electromotive voltage detected by the voltage detection unit with respect to time;

a storage unit configured to store time-series data of the differential value;

a maximum detection unit configured to detect a maximum point when the differential value has changed from an increase to a decrease by retrospectively tracing the time-series data in an opposite direction of a time series; and a valve closing time detection unit configured to execute a determination process of retrospectively tracing the time-series data from the maximum point detected by the maximum detection unit in the opposite direction and scanning whether or not an amount of decrease in the differential value from the maximum point exceeds a predetermined threshold value, and detect a maximum time, which is a time of the maximum point, as a valve closing time of the fuel injection valve when there is an event in which the amount of decrease exceeds the predetermined threshold value.

2. The control device according to claim 1, wherein the valve closing time detection unit executes the determination process for each maximum point when the maximum detection unit has detected a plurality of maximum points, and wherein, if there are a plurality of valve closing candidate points that are the maximum points when it is determined that there is an event in which the amount of decrease exceeds the predetermined threshold value as a result of the determination process, the valve closing time detection unit detects a shortest maximum time among maximum times of the valve closing candidate points as the valve closing time.

3. The control device according to claim 1, wherein the valve closing time detection unit executes the determination process for each maximum point when the maximum detection unit has detected a plurality of maximum points, and wherein, if there are a plurality of valve closing candidate points that are the maximum points when it is determined that there is an event in which the amount of decrease exceeds the predetermined threshold value as a result of the determination process, the valve closing time detection unit detects a maximum time of a valve closing candidate point at which the amount of decrease is largest among the valve closing candidate points as the valve closing time.

4. The control device according to claim 1, wherein the fuel injection valve includes a valve seat, a valve body configured to be separated from or in contact with the valve seat to open and close a fuel passage, a needle having a tip to which the valve body is fixed, and a movable core provided coaxially with the needle, and wherein the valve body is pulled up by a magnetic force generated by energizing the solenoid coil.

* * * * *